US007347665B2

(12) United States Patent
Thoma

(10) Patent No.: US 7,347,665 B2
(45) Date of Patent: Mar. 25, 2008

(54) RUBBER-ELASTIC ASSEMBLY FRAME FOR AN AXIAL VENTILATOR

(76) Inventor: Peter Thoma, Finkenweg 10a, 85625 Glonn (DE)

( * ) Notice: Subject to any disclaimer, the term of this patent is extended or adjusted under 35 U.S.C. 154(b) by 0 days.

(21) Appl. No.: 10/539,458

(22) PCT Filed: Oct. 15, 2003

(86) PCT No.: PCT/EP03/11435

§ 371 (c)(1),
(2), (4) Date: Mar. 22, 2006

(87) PCT Pub. No.: WO2004/059172

PCT Pub. Date: Jul. 15, 2004

(65) Prior Publication Data

US 2006/0165532 A1 Jul. 27, 2006

(30) Foreign Application Priority Data

Dec. 20, 2002 (DE) ..... 202 19 814 U

(51) Int. Cl.
*F03B 11/02* (2006.01)

(52) U.S. Cl. ..... 415/213.1; 416/244 R

(58) Field of Classification Search ..... 415/213.1, 415/214.1; 416/244 R, 247 R, 500, 93 R; 361/690, 695, 694
See application file for complete search history.

(56) References Cited

U.S. PATENT DOCUMENTS 6,351,380 B1 * 2/2002 Curlee et al. ..... 361/695
7,118,334 B2 * 10/2006 Winkler et al. ..... 415/213.1

FOREIGN PATENT DOCUMENTS

| | | |
|---|---|---|
| DE | 201 20 225 | 2/2002 |
| GB | 1 095 360 | 12/1967 |
| GB | 1 166 469 | 10/1969 |

OTHER PUBLICATIONS

"Fan Vibration Isolator" IBM Technical Disclosure Bulletin, vol. 33, No. 1B Jun. 1990.

* cited by examiner

*Primary Examiner*—Edward K. Look
*Assistant Examiner*—Dwayne J White
(74) *Attorney, Agent, or Firm*—Gallagher & Kennedy, P.A.; Thomas D. MacBlain

(57) ABSTRACT

The invention relates to a rubber elastic assembly frame for affixing an axial ventilator, which is provided with a mounting flange, to the wall of a housing of a device which is to be cooled. The assembly frame has formed locking elements for receiving the mounting flange and retaining elements for holding the assembly frame against the wall of the housing. The retaining elements are embodied in the form of mushroom-shaped projections (10).

5 Claims, 3 Drawing Sheets

Fig. 1
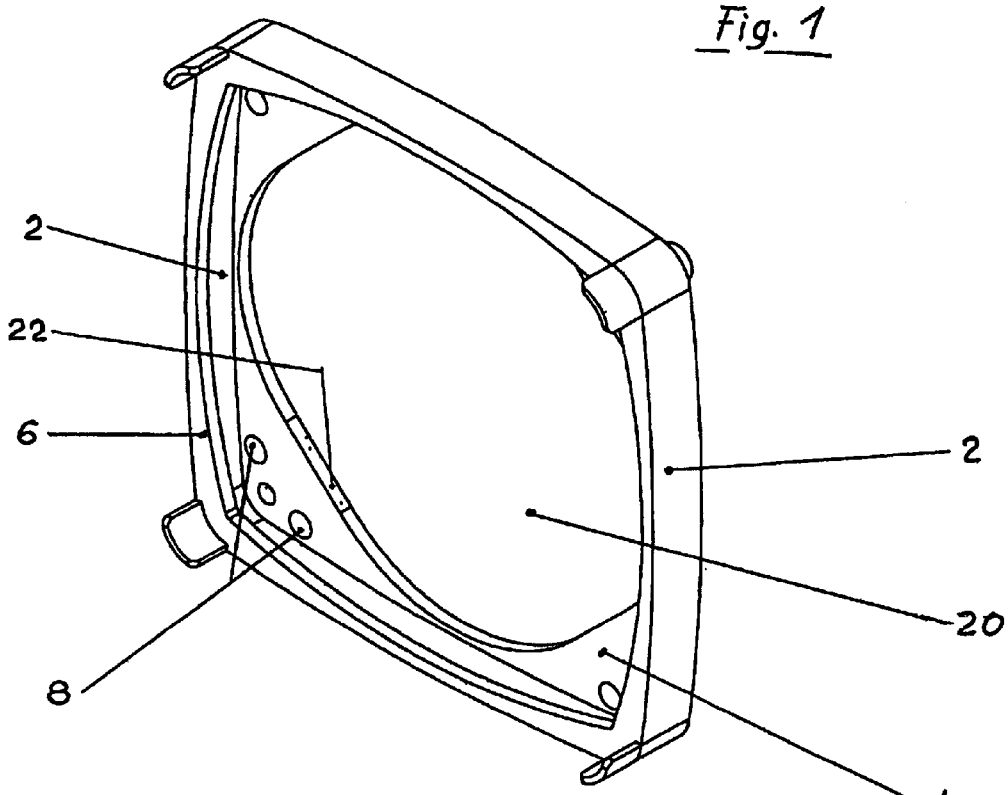
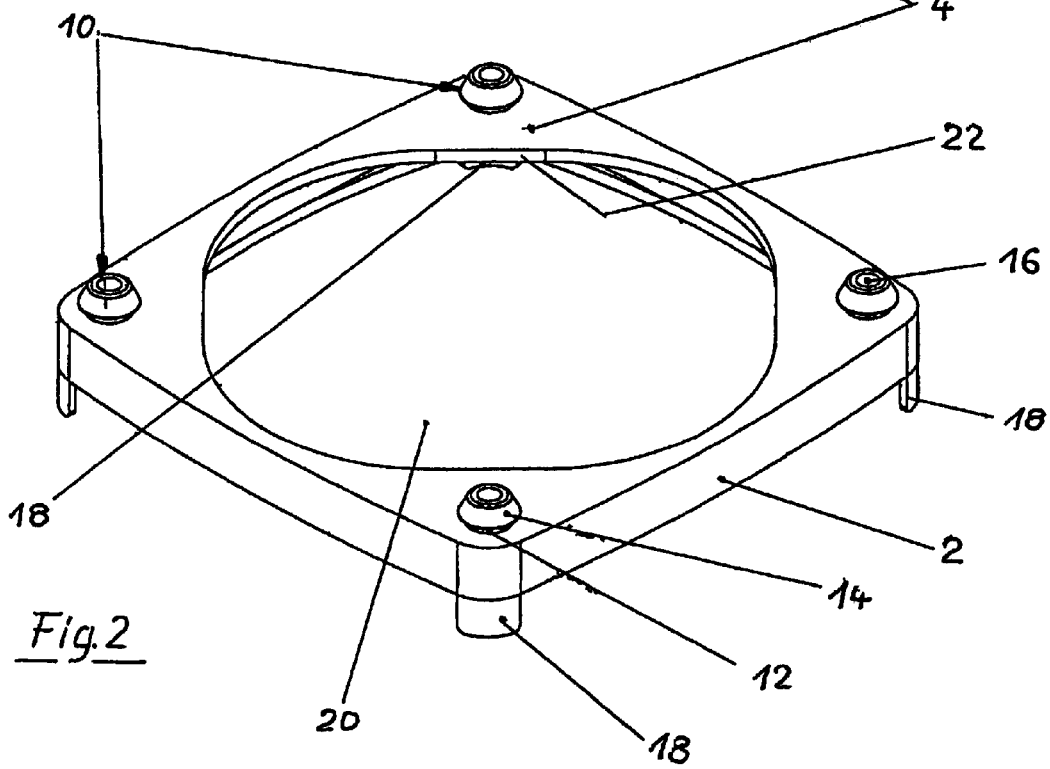
Fig. 2

Fig. 4
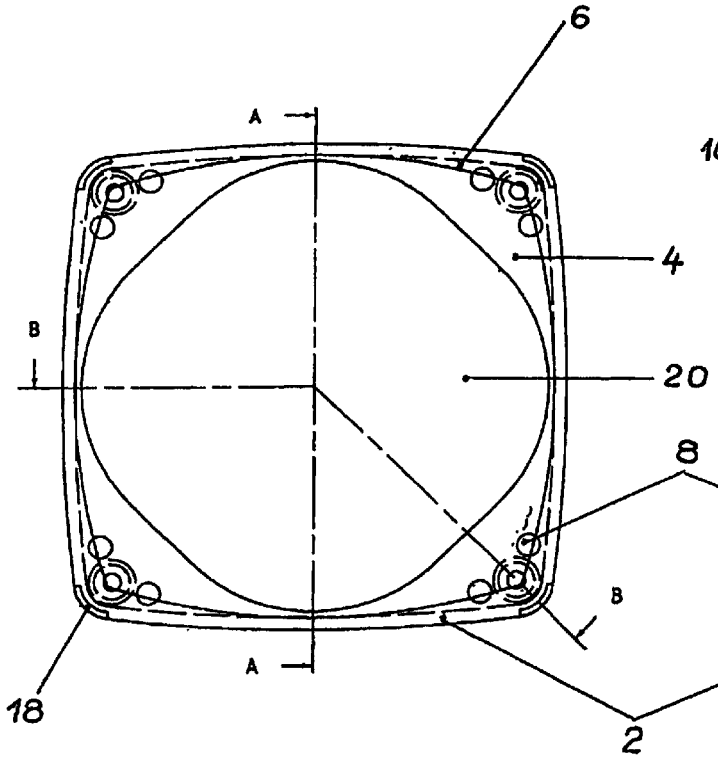
Fig. 5
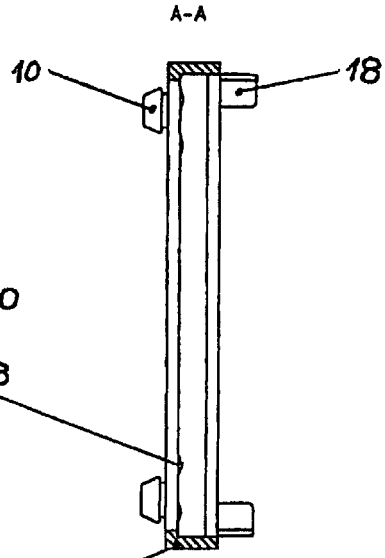
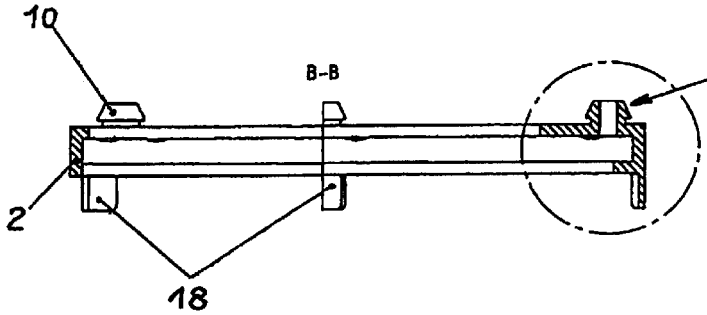
Fig. 6
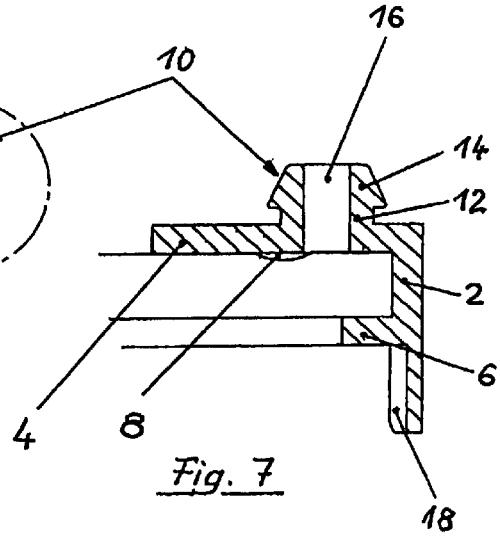
Fig. 7

RUBBER-ELASTIC ASSEMBLY FRAME FOR AN AXIAL VENTILATOR

The preferred embodiments of the present invention relate to a rubber-elastic assembly frame for affixing an axial ventilator to the wall of a housing of a device.

There is known from DE 32 10 164 C2 a retaining frame made of elastic plastic material for the assembly of an axial ventilator in an opening of the wall of a housing. With the aid of the ventilator, an electrical circuit accommodated in the housing is cooled. This rectangular assembly frame has outwardly projecting locking lugs on sides lying opposite one another. With the aid of the locking lugs, the rectangular assembly frame is locked at the opposite edges of the wall cutout. The rectangular ventilator housing sits inside this frame and is held fixed there with spring-loaded locking fingers.

Furthermore, there is known from DE 34 29 993 a rectangular rubber frame for affixing an axial ventilator in the wall of a housing. The frame has on one side a flange-like peripheral edge extending away in the axial direction, wherein the edge, when the ventilator is inserted, surrounds its mounting flange and grips around the same at individual points with nose-like projections. On the other side, the rubber frame has a peripheral groove which accommodates the edges of the assembly opening provided in the wall of the housing.

There is a need to provide an easily producible and assemblable rubber-elastic assembly frame for an axial ventilator, which frame efficiently damps the transmission of vibrations during operation of the ventilator to the wall of the housing of the device to be cooled and thus prevents disturbing sound radiation from the walls of the housing.

The present invention is directed to a devise that satisfies this need.

BRIEF DESCRIPTION OF THE DRAWINGS

Preferred embodiments of the present invention will be described in greater detail below with the aid of an exemplary embodiment illustrated in the appended drawings, together with an explanation of its advantages.

FIG. 1 shows a perspective view of an assembly frame according to an example of embodiment of the invention viewed from the ventilator side;

FIG. 2 shows a perspective view of the frame according to FIG. 1 viewed from the housing side;

FIG. 4 shows a view from below of the frame according to FIGS. 1 and 2;

FIG. 5 shows a section along line A-A through the frame according to FIG. 4;

FIG. 6 shows a section along line B-B through the frame according to FIG. 4; and FIG. 7 shows a detail of the part of FIG. 6 encircled with a dashed line.

DESCRIPTION

Figure 3:
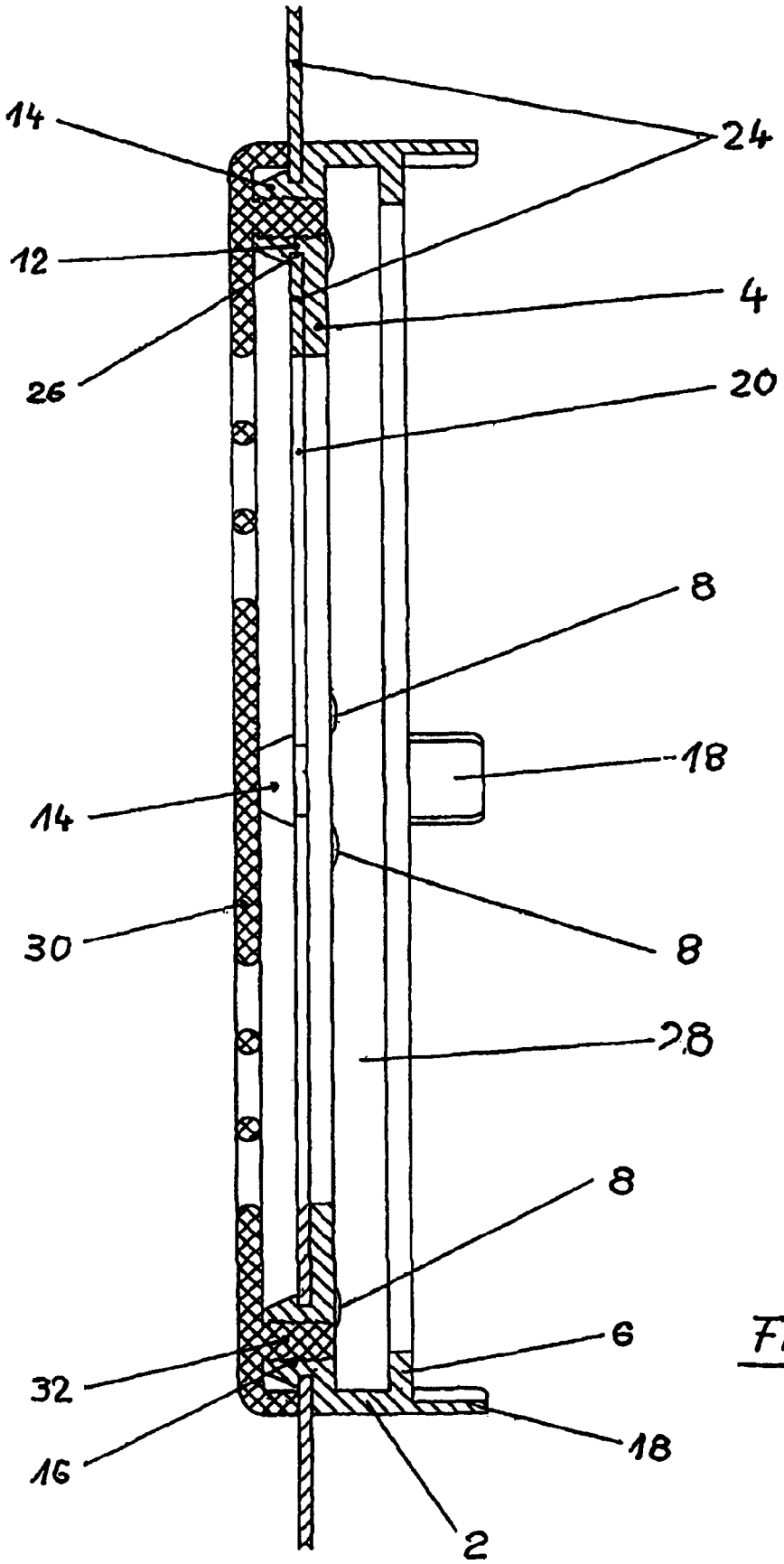
FIG. 3 shows a cross-section through the frame inserted in a wall of the housing according to FIGS. 1 and 2 with a fitted protective grid.

The frame according to the invention is preferably made of a rubber material, on the one hand of suitable firmness in order to guarantee reliable holding of the axial ventilator in the wall of the housing, but on the other hand of sufficient softness in order to prevent transmission of vibrations from the ventilator to the wall of the housing. According to FIGS. 1 and 2, the frame has a peripheral edge 2, at one side whereof locating segments 4 are formed in the region of the corners and at the other side whereof a retaining edge 6 is formed. An axial ventilator, not shown here, sits with its mounting flange inside the peripheral edge, the internal width whereof corresponds to the thickness of the mounting flange, so that locating segments 4 and retaining edge 6 lie adjacent to the mounting flange on both sides and thus serve as backing elements to secure the ventilator. In order to avoid full-surface contact of the wall-side area of the mounting flange with locating segments 4, the latter have on their side facing the mounting flange projecting studs 8, against which the mounting flange of the axial ventilator rests. By reducing the size of the contact area to virtually point-like contacts, a structure-borne sound transmission from the ventilator to the wall of the housing is again considerably reduced.

On the side of locating segments 4 facing away from the flange, there is in each case a mushroom-shaped projection 10 which serves as retaining elements to affix the frame to a wall of the housing, which for this purpose is provided with corresponding openings, which are arranged outside the main opening for the air flow generated by the ventilator and, if desired, can merge into the latter in a slit-like manner in order to facilitate the introduction of projections 10. Each projection 10 has a foot 12, whose length is dimensioned according to the thickness of the wall of the housing to which the ventilator is to be affixed. Head 14 of mushroom-shaped projection 10 is designed in the form of a truncated cone in the example of embodiment shown, in order to pass more easily through a fixing hole. The diameter of the fixing hole corresponds to the diameter of foot 12, in order to eliminate displacements of the frame with respect to the wall of the housing. In the example of the embodiment shown, projections 10 are penetrated by axially running holes 16 which are used for the fixing of a cover grid, as will be explained further in connection with FIG. 3.

At the corners, the peripheral edge 2 continues in the form of mounting tongues 18, which facilitate the fitting of the frame over the mounting flange of the axial ventilator.

It can further be seen in FIGS. 1 and 2 that the sides of the essentially square assembly frame—in the non-assembled state—are arched roughly barrel-shaped outwards and, accordingly, air opening 20 does not have a circular periphery, but has tangential segments 22 in the region of the four corners of the frame. When the frame is fitted onto the mounting flange of the ventilator, the corners are drawn outwards and the material is stretched, so that in the assembled state the frame assumes the square shape of the mounting flange and the aforementioned outward curvature of the sides disappears. Air opening 20 then approximates to the circular shape. The retention of the ventilator is again improved by the material endeavouring to assume its original shape again.

In the sectional representation of FIG. 3, a part of wall 24 of the housing is shown in order to illustrate the fixing of the assembly frame. It is possible to see smaller assembly openings 26 outside air opening 20 in wall 24 of the housing, through which assembly openings mushroom-shaped projections 10 extending away from locating segments 4 project with their neck or foot 12, whilst head 14 rests on the other side of wall 24 of the housing, so that the edge of assembly opening 26 sits in the groove formed by foot 12. In the assembled state of the axial ventilator, its mounting flange sits in channel 28, which is formed by locating segments 4, the inner wall of peripheral edge 2 and retaining edge 6.

With its face lying opposite the housing, the fixing flange rests on studs 8, instead of touching locating segments 4.

Furthermore, FIG. 3 shows a protective grid 30, which is inserted with pegs 32 into holes 16 of mushroom-shaped projections 10 and, as a result of a barb-shaped surface of pegs 32, is fixed in the elastic rubber material of the frame.

The sectional drawings shown in FIGS. 4, 5 and 6 show in greater detail the design of the parts explained in connection with FIGS. 1 to 3. FIG. 7 illustrates the design of mushroom-shaped projection 10 with its foot 12, said projection extending away from locating segment 4, head 14 in the form of a truncated cone and hole 16. The flat shape of studs 8 can also be seen more clearly here.

Although the present invention has been described in considerable detail with reference to certain preferred versions thereof, other versions are possible. Therefore, the spirit and scope of the appended claims should not be limited to the description of the preferred versions contained herein.

The invention claimed is:

1. A rubber-elastic assembly frame for affixing an axial ventilator provided with a mounting flange to the wall of a housing of a device to be cooled, comprising formed locking elements for receiving the mounting flange and retaining elements for holding the assembly frame to the wall of the housing, wherein the retaining elements are designed as mushroom-shaped projections, further comprising one or more tension tongues, each tension tongue formed at an edge of the assembly frame and capable of fitting onto the mounting flange.

2. The assembly frame according to claim 1, wherein the frame is rectangular-shaped and the one or more tension tongues are each arranged at a corner of the rectangular-shaped frame.

3. A rubber-elastic assembly frame for affixing an axial ventilator provided with a mounting flange to the wall of a housing of a device to be cooled, comprising formed locking elements for receiving the mounting flange and retaining elements for holding the assembly frame to the wall of the housing, wherein the retaining elements are designed as mushroom-shaped projections, wherein the frame is rectangular-shaped and the contour of the rectangular-shaped frame bulges out in a barrel-like manner in an unassembled state.

4. The assembly frame according to claim 3, wherein, while in the unassembled state, the internal contour of the frame bounds an air opening and is substantially circular with regions flattened at the corners.

5. A rubber-elastic assembly frame for affixing an axial ventilator provided with a mounting flange to the wall of a housing of a device to be cooled, comprising formed locking elements for receiving the mounting flange and retaining elements for holding the assembly frame to the wall of the housing, wherein the retaining elements are designed as mushroom-shaped projections, further comprising stud-like projections at contact points of the mounting flange on the housing side.

* * * * *